US011028666B2

(12) United States Patent
Sommers

(10) Patent No.: US 11,028,666 B2
(45) Date of Patent: Jun. 8, 2021

(54) APPARATUS FOR ISOLATING ONE OR MORE ZONES IN A WELL

(71) Applicant: Target Completions LLC, Broken Arrow, OK (US)

(72) Inventor: Michael Thomas Sommers, Broken Arrow, OK (US)

(73) Assignee: Target Completions LLC, Broken Arrow, OK (US)

( * ) Notice: Subject to any disclaimer, the term of this patent is extended or adjusted under 35 U.S.C. 154(b) by 34 days.

(21) Appl. No.: 16/676,506

(22) Filed: Nov. 7, 2019

(65) Prior Publication Data

US 2021/0140264 A1 May 13, 2021

(51) Int. Cl.

| | |
|---|---|
| ***E21B 33/128*** | (2006.01) |
| ***E21B 33/129*** | (2006.01) |
| ***E21B 33/134*** | (2006.01) |
| ***E21B 33/13*** | (2006.01) |

(52) U.S. Cl.

CPC ..... *E21B 33/128* (2013.01); *E21B 33/1293* (2013.01); *E21B 33/13* (2013.01); *E21B 33/134* (2013.01)

(58) Field of Classification Search

CPC .... E21B 33/128; E21B 33/1293; E21B 33/13; E21B 33/134

See application file for complete search history.

(56) References Cited

U.S. PATENT DOCUMENTS

| | | | | |
|---|---|---|---|---|
| 4,784,226 | A * | 11/1988 | Wyatt | E21B 23/06 166/182 |
| 5,819,846 | A * | 10/1998 | Bolt, Jr. | E21B 33/134 166/123 |
| 6,354,372 | B1 * | 3/2002 | Carisella | E21B 23/01 166/118 |
| 6,796,376 | B2 * | 9/2004 | Frazier | E21B 33/129 |
| 9,010,411 | B1 * | 4/2015 | VanLue | E21B 34/06 166/118 |
| 9,896,901 | B2 | 2/2018 | Sommers | |
| 10,808,480 | B2 * | 10/2020 | Hern | E21B 23/065 |
| 2004/0003928 | A1 * | 1/2004 | Frazier | E21B 33/134 166/387 |
| 2015/0285026 | A1 * | 10/2015 | Frazier | E21B 33/134 166/120 |
| 2018/0171749 | A1 * | 6/2018 | Yue | E21B 33/1293 |
| 2018/0328130 | A1 * | 11/2018 | Smith | E21B 33/1293 |

* cited by examiner

*Primary Examiner* — Yong-Suk (Philip) Ro
(74) *Attorney, Agent, or Firm* — Merek, Blackmon & Voorhees, LLC

(57) ABSTRACT

An isolation tool that is installed in a well by a setting tool to isolate at least a portion of the well. Preferably, the isolation tool is a plug and the plug and setting tool are configured to prevent premature setting of the plug. Preferably, the plug includes one or more portions that directly connect the plug to a setting tool wherein the one or more portions of the plug shear during setting of the plug in an operating position. In a most preferred form, the plug includes first and second longitudinally spaced portions that directly connect the plug to a setting tool wherein the first and second portions shear during setting of the plug in an operating position. In a most preferred form, the plug and setting tool are configured so that no portion of the setting tool shears during the installation of the plug, separation of the plug from the setting tool and removal of the setting tool.

20 Claims, 6 Drawing Sheets

APPARATUS FOR ISOLATING ONE OR MORE ZONES IN A WELL

FIELD OF THE INVENTION

Preferred forms of the present invention are directed to bridge or frac plugs that are installed/set in a drilled open hole to isolate at least a portion of the drilled open hole (e.g., well bore) and setting tools for setting the plugs. A preferred form of the present invention includes a bridge or frac plug and a setting tool that are configured to prevent premature setting of the bridge or frac plug. A preferred form of the present invention includes a bridge or frac plug that includes one or more portions that directly connect the bridge or frac plug to a setting tool wherein the one or more portions of the bridge or frac plug shear during setting of the bridge or frac plug in an operating position. In a most preferred form of the present invention, the bridge or frac plug includes first and second longitudinally spaced portions that directly connect the bridge or frac plug to a setting tool wherein the first and second longitudinally spaced portions of the bridge or frac plug shear during setting of the bridge or frac plug in an operating position. In a most preferred form of the invention, no portion of the setting tool shears during installation of the bridge or frac plug and/or removal of the setting tool. In a most preferred form of the invention, neither the bridge/frac plug or the setting tool requires a collet to detachably connect the plug to the setting tool.

BACKGROUND OF THE INVENTION

Various tools (e.g., plugs) have been developed to isolate one or more portions of a well bore to facilitate the well-known frac process or operation. The frac process or operation results in the formation of fractures or cracks that allow hydrocarbons to be extracted. This process or operation may be repeated as desired until all target zones in the well bore are fractured.

The frac process is initiated by drilling an open hole. A shoe track consisting of a shoe guide and a latch down float may be inserted in the open hole and cemented therein to form a casing or tubular in the open hole. Applied pressure in the casing or tubular activates the launch to create communication between the casing and the open hole. Subsequently, a plug and a perf gun are inserted in the well bore by a setting tool. The setting tool sets the plug at a predetermined location in the well bore. The plug can be oriented horizontally or vertically. Once the plug is properly set the setting tool is disconnected from the plug. The perforation process can now commence. After the perforation process has been completed, the setting tool is removed from the well and a sealing element is inserted into the well to engage a top portion or an upper seat or end of the plug. The sealing element can be a ball which is removable or dissolvable. Once the sealing element is properly installed the frac can now begin. After all steps of the frac are completed, the sealing element dissolves or is removed depending upon the type of sealing element used clearing the path from production.

A significant concern in the process of installing the plug is premature setting of the plug. To address the significant concern of premature setting of the plug, a preferred form of the present invention provides a plug that prevents or significantly reduces premature setting of the plug. Further, previously developed plugs have a complex design requiring the setting tool and the plug to each have collets to install and set the plug in a well bore. In addition, prior devices have required the setting tool to have one or more elements that shear during the setting process to remove the setting tool requiring the sheared portions of the setting tool to be replaced before the setting tool can be reused. To address these concerns as well as other concerns, a preferred form the present invention provides a simplified construction wherein neither the setting tool nor the plug has a collet and no portion of the setting tool need shear to disconnect the setting tool from the plug allowing the setting tool to be readily reused without replacing any sheared component or portion of the setting tool.

OBJECTS AND SUMMARY OF THE INVENTION

An object of a preferred form of the present invention is to provide a novel and unobvious apparatus for installation in a well bore for isolating at least a portion of the well bore.

Another object of a preferred form of the present invention is to provide an apparatus having an isolation member which is to be set in a well bore at a predetermined location for isolating at least a portion of the well bore and a tool for setting the isolation member wherein the apparatus is configured to prevent or significantly reduce premature setting of the isolation member.

A further object of a preferred embodiment of the present invention is to provide a bridge or frac plug and/or setting tool that are configured to prevent or significantly reduce premature setting of the bridge or frac plug in a well bore.

Still another object of a preferred embodiment of the present invention is to provide a bridge or frac plug having a first portion and a second portion that are spaced from each other along a longitudinal axis of the plug that detachably connect the plug to a setting tool at two longitudinally spaced points or sections of the setting tool.

A further object of a preferred embodiment of the present invention is to provide a bridge or frac plug having a first portion and a second portion that are spaced from each other along a longitudinal axis of the plug and that connect the plug to a setting tool at two longitudinally spaced sections of the setting tool to allow the setting tool to precisely set the plug at a predetermined location in the well bore wherein the first and second portions of the plug are configured to shear during the plug setting process to disconnect the plug from the setting tool.

Yet another object of a preferred embodiment of the present invention is to provide a bridge or frac plug that is set in a predetermined location in a well bore by a setting tool wherein the plug and/or setting tool are configured such that no portion of the setting tool need shear to disconnect the setting tool from the plug.

Yet a further object of a preferred embodiment of the present invention is to provide a bridge or frac plug that is set in a predetermined location in a well bore by a setting tool wherein neither the plug nor the setting tool includes a collect to detachably connect the plug to the setting tool.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to an apparatus for installation in a well bore for isolating at least a portion of the well bore. The apparatus includes a multi-piece plug configured to be installed in an operating position in a well bore by a setting tool detachably connected to the multi-piece plug. The multi-piece plug includes a first portion and a second portion. The first portion is offset along a longitudinal axis of the multi-piece plug from the second portion. The first portion of the multi-piece plug being configured to engage a first portion of the setting tool to connect the multi-piece plug to the setting tool at a first location while the multi-piece plug travels in the well bore to the operating position. The second portion of the multi-piece plug is configured to engage a second portion of the setting tool to connect the multi-piece plug to the setting tool at a second location while the multi-piece plug travels in the well bore to the operating position. The first portion and the second portion of the multi-piece plug prevent premature setting of the bridge plug.

Another preferred embodiment of the present invention is directed to a bridge plug configured to be installed in a well bore in an operating position by a setting tool for isolating a portion of the well bore. The bridge plug includes a multi-piece body configured to be installed in an operating position in a well bore wherein the multi-piece body is fixed to the well bore when installed in the operating position. The multi-piece body of the bridge plug has a first portion and a second portion. The first portion is offset along a longitudinal axis of the multi-piece body from the second portion. The first portion of the multi-piece body of the bridge plug is configured to engage a first portion of a setting tool to connect the bridge plug to the setting tool at a first location while the bridge plug travels in the well bore to the operating position. The second portion of the multi-piece body of the bridge plug is configured to engage a second portion of the setting tool to connect the bridge plug to the setting tool at a second location while the bridge plug travels in the well bore to the operating position, wherein the first portion and the second portion of the multi-piece body of the bridge plug are configured to shear during setting of the multi-piece body of the bridge plug in the operating position.

A further preferred embodiment of the present invention is directed to a bridge plug configured to be installed in a well bore in an operating position by a setting tool for isolating a portion of the well bore. The bridge plug includes a multi-piece body configured to be installed in an operating position in a well bore wherein the multi-piece body is fixed to the well bore when installed in the operating position. The multi-piece body of the bridge plug having an end cap. The end cap is positioned adjacent a terminal end of a setting tool and spaced from a sealing element configured to engage an end of the multi-piece body opposite an end of the multi-piece body adjacent the terminal end of the setting tool. The end cap of the multi-piece body has an inwardly projecting annular portion. The inwardly projecting annular portion is configured to shear during setting of the multi-piece body.

The preferred forms of the present invention described above provide various examples of preferred embodiments of the present invention and are not to be construed as limiting the present invention to any of the preferred forms described above.

DETAILED DESCRIPTION OF THE PREFERRED EMBODIMENTS OF THE INVENTION

The preferred forms of the invention will now be described with reference to FIGS. 1-6. The appended claims are not limited to the preferred forms and no term and/or phrase used herein is to be given a meaning other than its ordinary meaning unless it is expressly stated otherwise. In particular, "multi-piece" as used herein means more than one piece, e.g., a plug having two or more pieces is a multi-piece plug and a body having two or more pieces is a multi-piece body.

Figure 5:
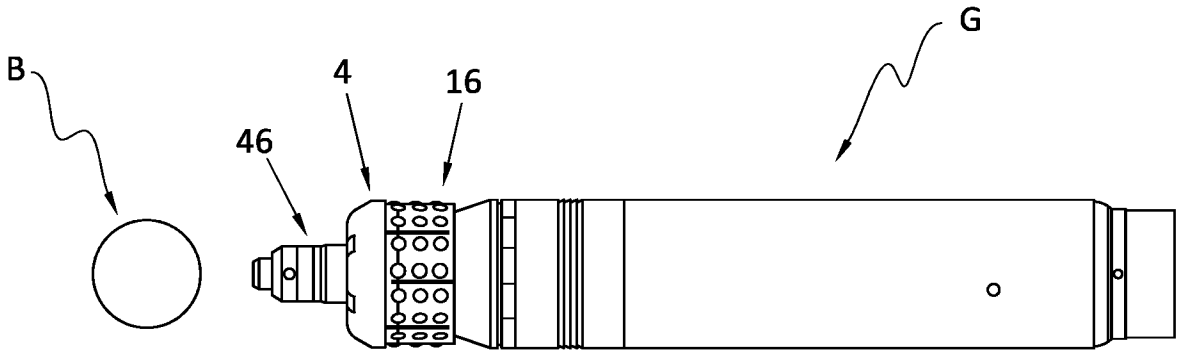
FIG. 5 is an elevational view of an alternative form of a bridge or frac plug connected to a setting tool similar depicted in FIG. 4.
Figure 6:
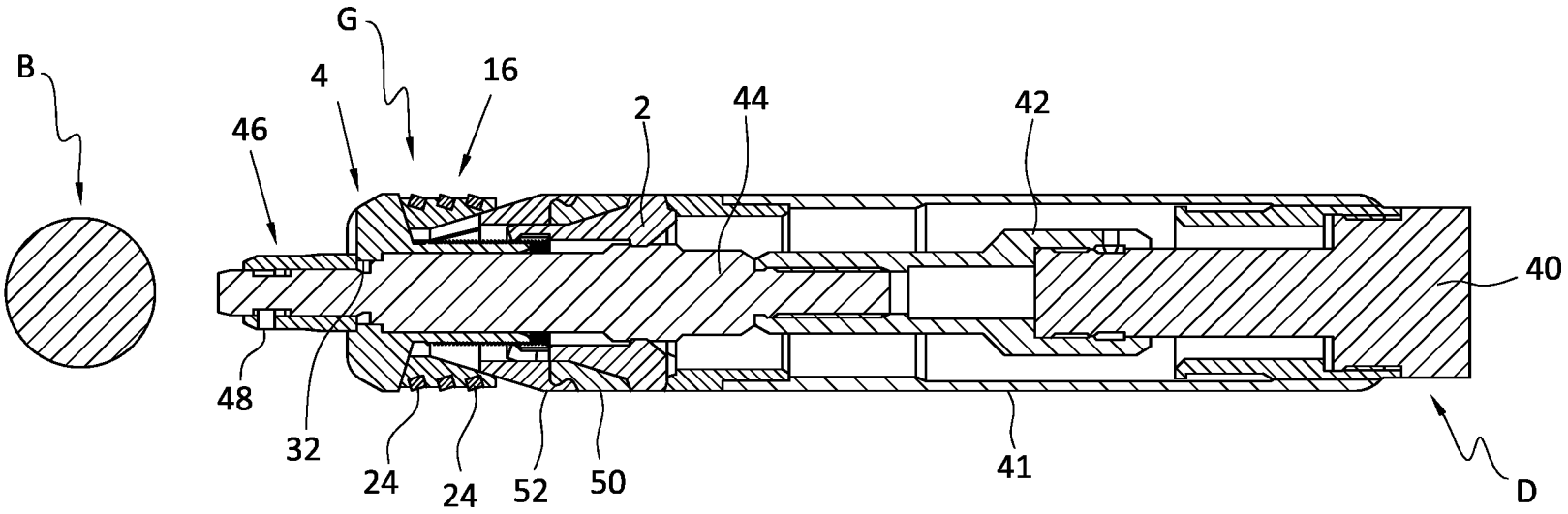
FIG. 6 is cross-sectional view of the alternative embodiment depicted in FIG. 5.

Two preferred embodiments are disclosed and described herein. The first preferred embodiment is depicted in FIGS. 1 to 4 and the second preferred embodiment is depicted in FIGS. 5 and 6. While two preferred embodiments are depicted, the scope of the present invention includes numerous variations thereof.

A feature common to both preferred embodiments is the design of the frac or bridge plug to connect the frac plug to the plug setting tool in two different locations (e.g., longitudinally spaced locations) to keep the frac plug from setting prematurely. Another common feature of the preferred embodiments, is the design of the frac or bridge plug and the setting tool wherein no portion of the setting tool needs to shear to separate the frac or bridge plug from the setting tool. A further common feature of the preferred embodiments is the design of a frac or bridge plug to have an end cap at a terminal end of the frac or bridge plug having an inwardly extending annular portion that engages a corresponding portion of the setting tool to connect a terminal end of the plug to the setting tool wherein the inwardly extending annular portion is configured to shear during setting of the plug. Yet a further common feature of the preferred embodiments is the design of the plug and setting tool such that a first portion of the plug adjacent a first end of the plug removably connects the plug to a first section of the setting tool and a second portion of the plug adjacent a second end of the plug opposite the first end of the plug removably connects the plug to a second section of the setting tool.

FIGS. 1 Through 4

Figure 1:
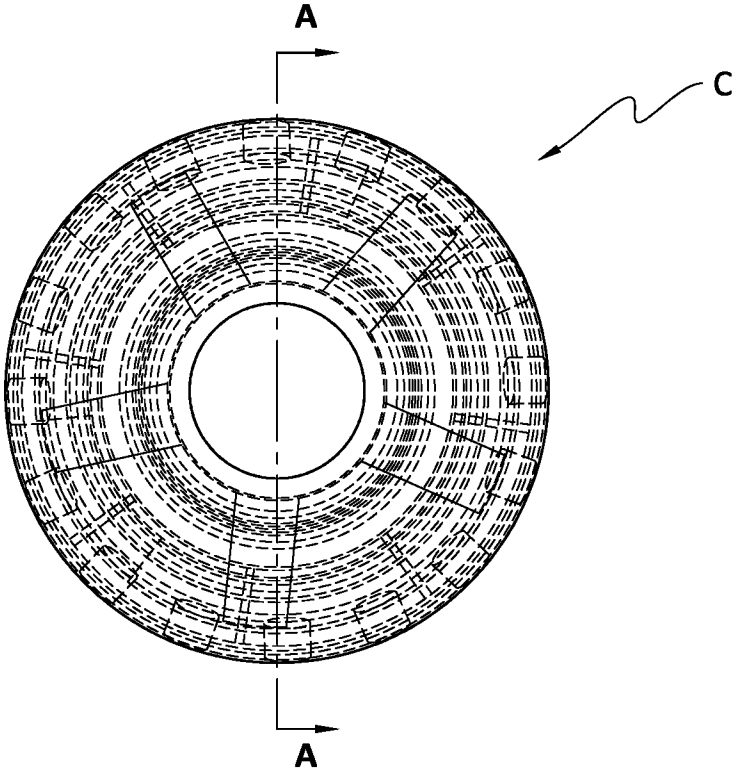
FIG. 1 is an elevational, end view of a bridge or frac plug formed in accordance with a preferred embodiment of the present invention.
Figure 2:
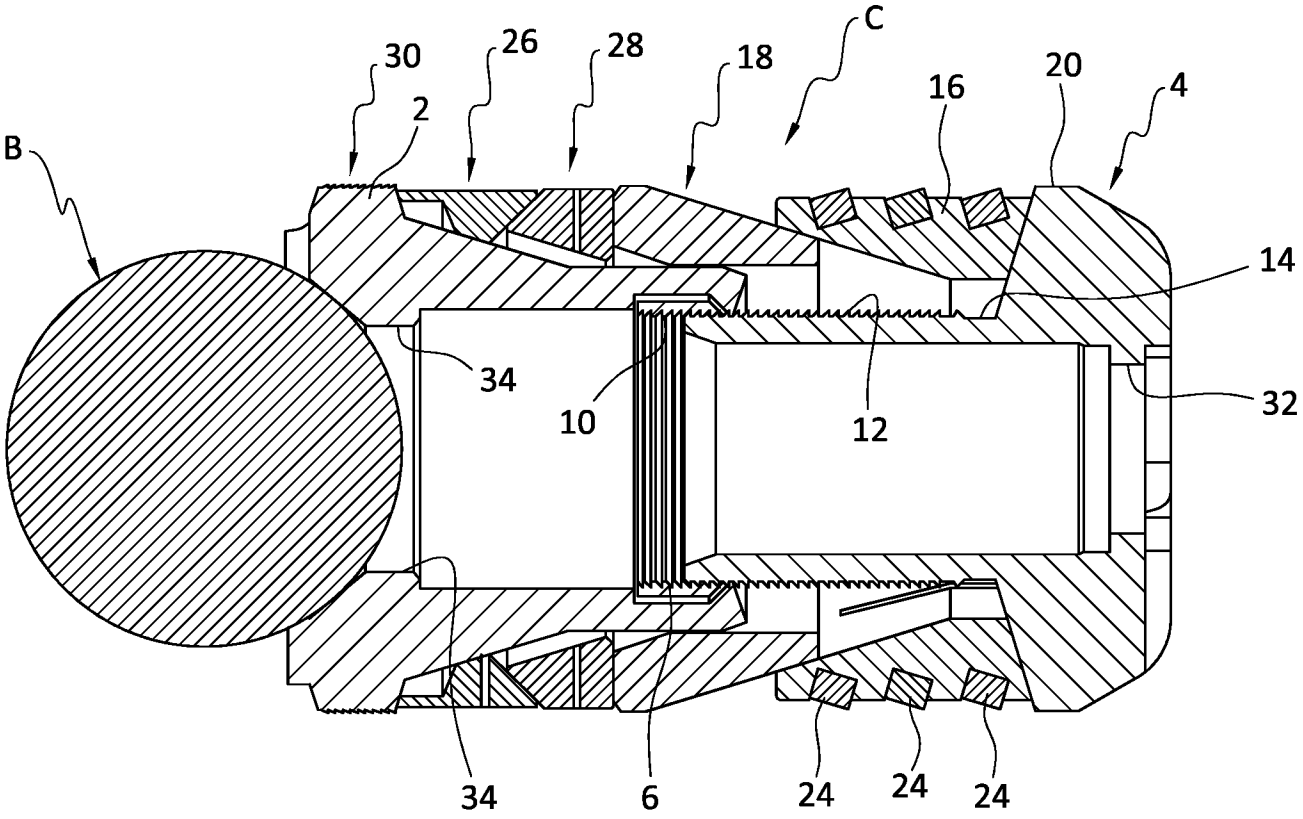
FIG. 2 is a cross-sectional view taken along lines A-A in FIG. 1.

Referring to FIGS. 1 to 4, a well bore tool A employing a preferred form of the invention is illustrated in one of many possible configurations. Well bore tool A includes a sealing element B, a multi-piece plug C and a plug setting tool D. Preferably, multi-piece plug C is a bridge or frac plug configured to isolate a portion of a well bore to facilitate a fracing process or operation. The plug C can be oriented horizontally or vertically in a corresponding section of a well bore. Sealing element B is preferably a ball that seats on an upper portion of plug C subsequent to plug C being set in a predetermined location in the well bore as seen in FIG. 2. However, sealing element B can take any suitable form. Sealing element B can be configured to be removed or dissolved to clear the path for production. For example, sealing element B can be configured to dissolve after a predetermined period of time (e.g., ten days). One or more components of plug C can also be configured or formed to dissolve after a predetermined period of time. For example, the bulk/majority or all of the components of plug C can be configured or formed to dissolve after a predetermined period of time (e.g., ten days). If one or more slips with ceramic gripping elements partially embedded in the slip body are used, the slip body but not the ceramic gripping element will dissolve. However, non-ceramic gripping elements can be partially embedded in the slip body so that the gripping elements and slip body both dissolve. Also, if one or more rubber sealing components form a portion of plug C, these rubber sealing components also dissolve.

Referring to FIGS. 1 to 4, plug C includes a mandrel 2 preferably forming an upper terminal end of plug C and a lower end cap 4 forming a lower terminal end of plug C. A lock nut 6, seats in lower inner section 8 of mandrel 2. Lock nut 6 includes inner threads 10 that are complimentary to external threads 12 formed on the exterior of upper section 14 of end cap 4 to connect mandrel 2 to end cap 4 while allowing end cap 4 to move along a longitudinal axis of the well bore relative to mandrel 2 during the process of setting plug C.

Figure 3:
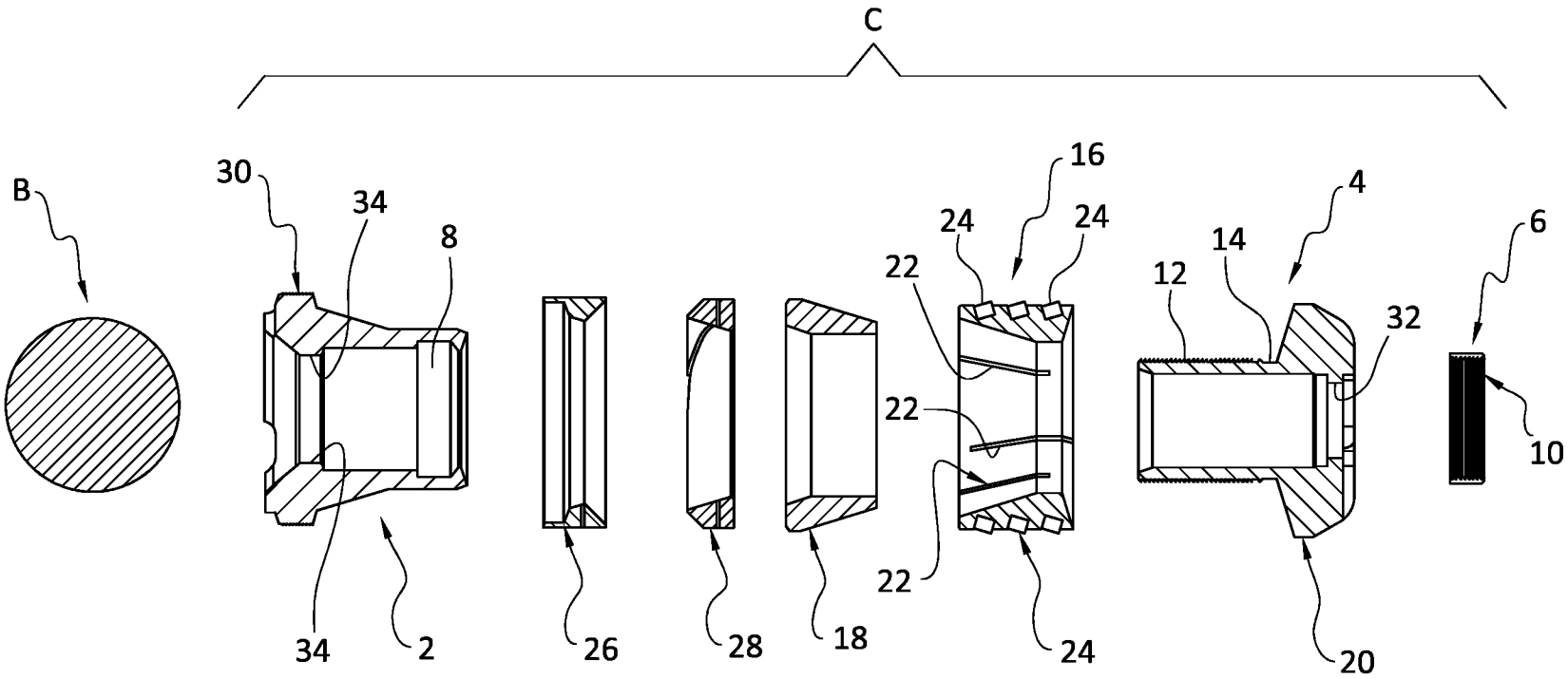
FIG. 3 is an exploded, cross-sectional view of the plug depicted in FIGS. 1 and 2.

Plug C further preferably includes one or more ceramic slips 16 (only one slip is shown) disposed between cone 18 and a lower section 20 of cap 4. As seen in FIG. 2, slip 16 is disposed to ride/slide on an exterior surface of cone 18 during the process of setting plug C. Referring to FIG. 3, a plurality of slits 22 may be formed in slip 16 to facilitate or allow slip 16 to split or fracture into two or more sections to allow for radial expansion. Slip 16 may include a plurality of gripping or friction elements 24 (e.g., inserts) that facilitate setting of plug C in the well bore.

Plug C further preferably includes an upper expansion ring 26 and a lower expansion ring 28 disposed between cone 18 and upper section 30 of mandrel 2. Rings 26 and 28 are configured to expand radially during the process of setting plug C.

Plug C preferably include two shear portions 32 and 34 that are spaced from each other along a longitudinal axis of plug C. Shear section or portion 32 is preferably formed on an inner surface of end cap 4 and can take the form on an inwardly projecting annular ring or shoulder. Shear portion 34 is preferably formed on an inner surface of mandrel 2 adjacent an upper end of plug C and can take the form of inwardly projecting threads that mate with complimentary threads on an adjacent portion of the plug setting tool D. Shear portions 32 and 34 detachably connect plug C to the setting tool D at two longitudinally spaced areas, sections or points. Shear portions 32 and 34 cooperate with corresponding portions of the setting tool to prevent premature setting of plug C. In this preferred embodiment, the shear portions 32 and 34 are disposed adjacent upper and lower end portions of the plug C.

Figure 4:
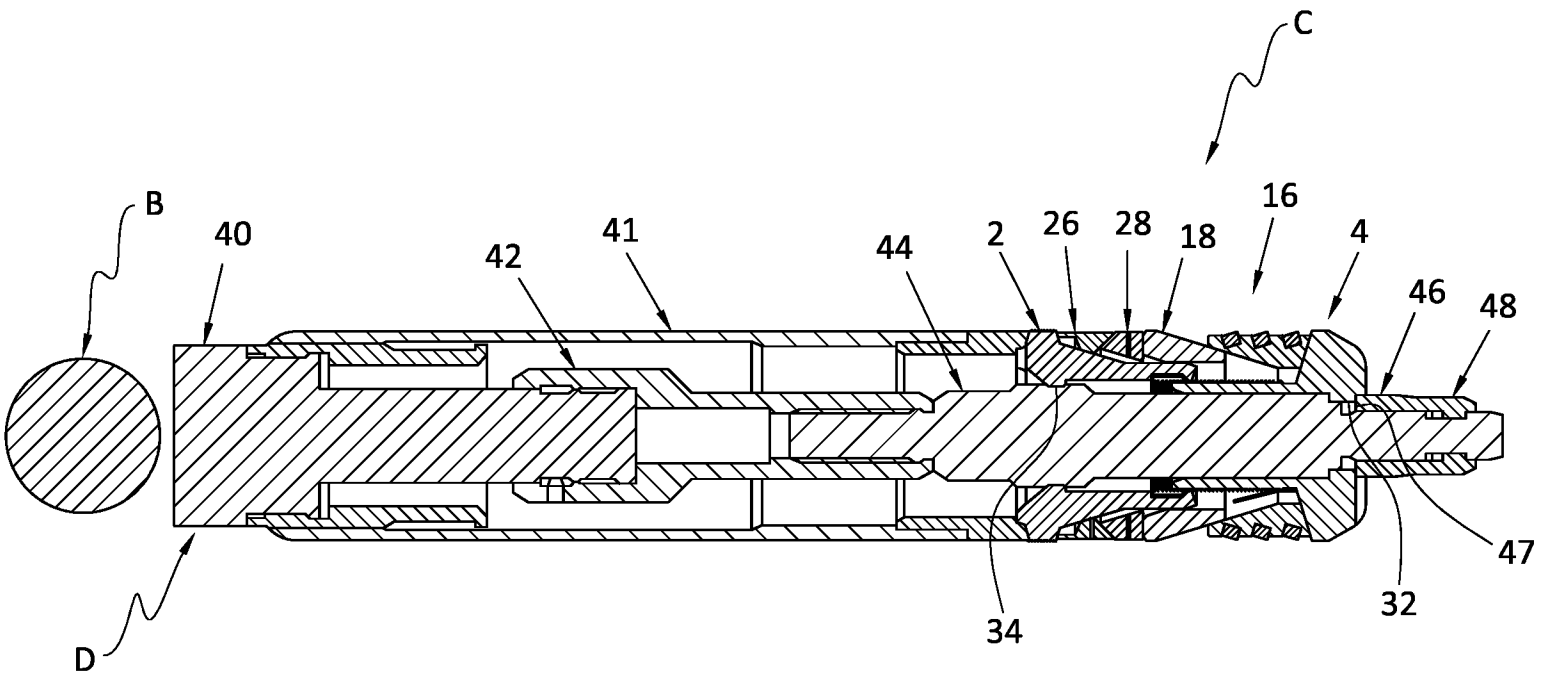
FIG. 4 is a cross-sectional view of the plug depicted in FIGS. 1 to 3 connected to a setting tool formed in accordance with a preferred embodiment of the present invention.

Referring to FIG. 4, setting tool D preferably includes a setting gun 40, a housing or setting sleeve 41, an intermediate member or inner adapter 42, a lower member or inner adapter rod 44 and a removable end cap 46. Adapter 42, as seen in FIG. 4, connects an end of gun 40 to adapter rod 44. End cap 46 has internal threads that allow end cap 46 to be threaded on a threaded portion of adapter 44. One or more set screws 48 detachably connect end cap 46 to adapter rod 44. An uppermost radially extending surface 47 of end cap 46 directly abuts shear portion 32 of plug C.

The plug C and setting tool D are inserted as a unit into the well bore at a predetermined or desired location and the setting gun 40 is subsequently fired. Once the setting gun 40 is fired, the setting tool D will move to the left as viewed in FIG. 4. This movement of setting tool D will cause the internal threads 34 of mandrel 2 to shear. Further, leftward movement will cause elements 26, 28 and 16 to move outwardly a sufficient distance to set the frac plug. Element 16 will be forced outwardly by the conical shape of member 18. Elements 26 and 28 will be forced outwardly by the conically shaped section of member 2. This further leftward movement will also cause the inset or inwardly extending annular ring 32 of end cap 4 to shear. This allows all elements of the setting tool D to be freed or detached from plug C to allow the setting tool D to be moved relative to the plug C and removed from the well while the plug C is set in an operating position.

To mount the frac plug C on the setting tool D to install the plug in an operating position using setting tool D, plug C is mounted on or about adapter rod 44 by threading portion 34 onto a corresponding threaded portion of adapter 44. End cap 46 of the setting tool D is then connected to a lower end of adapter rod 44 of setting tool D to engage the inwardly extending portion 32 of plug C. One or more set screws 48 are used to connect end cap 46 to adapter rod 44 so that the radially extending and annular surface of the upper portion of end cap 46 of setting tool D engages the lower annular and radially inwardly extending surface of portion 32 of end cap 4 of plug C.

FIGS. 5 and 6

Referring to FIGS. 5 and 6, another preferred embodiment will be described which is similar to the embodiment disclosed and described in connection with FIGS. 1 to 4. The setting tool is identical to the setting tool of the first embodiment depicted in FIGS. 1 to 4. The only difference between the first embodiment in FIGS. 1 to 4 and the second embodiment in FIGS. 5 and 6 is the bridge or frac plug. The same components/pieces/sections are given the same reference letters and numerals to designate the same components of the two embodiments.

Frac or bridge plug G will now be described in connection with FIGS. 5 and 6. The detachable connection of plug G and the setting tool D are identical to the first embodiment depicted in FIGS. 1 to 4, i.e. two longitudinally spaced portions 32 and 34 of the plug G connect plug G to the setting tool wherein portions 32 and 34 shear during setting of plug G in the same manner as described in connection with the first embodiment. Plug G includes mandrel 2, end cap 4 and one or more slips 16 which are identical to the corresponding components of plug C. Plug G differs from plug C in that elements 18, 26 and 28 of plug C have been replaced with a rubber sealing element 50 interconnected to cone 52. As seen in FIG. 6, a lower end of cone 52 interlocks with an upper end of rubber sealing element 50. Rubber element 50 facilitates sealing of the well portion. Slip 16 and sealing element expand radially outward to set plug G. More specifically, during setting, an inner surface of slip 16 will ride/slide along the tapered external surface of cone 52 causing slip to move radially outward and rubber element 50 will be compressed causing element 50 to expand outwardly to set plug G.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. An apparatus for installation in a well bore for isolating at least a portion of the well bore, said apparatus comprising:

a multi-piece plug configured to be installed in an operating position in a well bore by a setting tool detachably connected to the multi-piece plug, said multi-piece plug having a first portion and a second portion, said first portion is offset along a longitudinal axis of said multi-piece plug from said second portion, said first portion of said multi-piece plug being configured to engage a first portion of the setting tool to connect said multi-piece plug to the setting tool at a first location while said multi-piece plug travels in the well bore to the operating position, said second portion of said multi-piece plug being configured to engage a second portion of the setting tool to connect said multi-piece plug to the setting tool at a second location while said multi-piece plug travels in the well bore to the operating position, said first portion and said second portion of said multi-piece plug prevent premature setting of the multi-piece plug.

2. The apparatus as set forth in claim 1, wherein:

said first portion of said multi-piece plug is configured to shear during setting of the multi-piece plug.

3. The apparatus as set forth in claim 2, wherein:

said first portion of said multi-piece plug directly engages a surface of the setting tool and, wherein no portion of the setting tool shears during installation of said multi-piece plug.

4. The apparatus as set forth in claim 3, wherein:

said first portion of said multi-piece plug is spaced from a terminal end of the setting tool a distance greater than said second portion of said multi-piece plug is spaced from the terminal end of the setting tool.

5. The apparatus as set forth in claim 2, wherein:

said second portion of said multi-piece plug is configured to shear during setting of the multi-piece plug.

6. The apparatus as set forth in claim 5, wherein:

said second portion of said multi-piece is configured to shear after said first portion is sheared during setting of the multi-piece plug.

7. The apparatus as set forth in claim 6, wherein:

shearing of said second portion of said multi-piece plug allows the setting tool to be removed while the said multi-piece plug remains in the operating position.

8. The apparatus as set forth in claim 7, wherein:

said second portion of said multi-piece plug is formed on an end cap forming a terminal end of said multi-piece plug.

9. The apparatus as set forth in claim 8, wherein:

said second portion of said multi-piece plug is an inwardly extending annular portion configured to engage a removable cap of the setting tool.

10. The apparatus as set forth in claim 1, wherein:

said multi-piece plug includes at least one member for fixing said multi-piece plug to the well bore, said at least one member being disposed between said first portion and a terminal end of the setting tool.

11. A bridge plug configured to be installed in a well bore in an operating position by a setting tool for isolating a portion of the well bore, said bridge plug comprising:

a multi-piece body configured to be installed in an operating position in a well bore wherein said multi-piece body is fixed to the well bore when installed in the operating position, said multi-piece body of said bridge plug having a first portion and a second portion, said first portion is offset along a longitudinal axis of said multi-piece body from said second portion, said first portion of said multi-piece body of said bridge plug being configured to engage a first portion of a setting tool to connect said multi-piece body of said bridge plug to the setting tool at a first location while said multi-piece body of said bridge plug travels in the well bore to the operating position, said second portion of said multi-piece body of said bridge plug being configured to engage a second portion of the setting tool to connect said multi-piece body of said bridge plug to the setting tool at a second location while said multi-piece body of said bridge plug travels in the well bore to the operating position, wherein said first portion and said second portion of said multi-piece body of said bridge plug are configured to shear during setting of said multi-piece body of said the bridge plug in the operating position.

12. The bridge plug as set forth in claim 11, wherein:

said first portion of said bridge plug is spaced from a terminal end of the setting tool a distance greater than said second portion of said bridge plug is spaced from the terminal end of the setting tool.

13. The bridge plug as set forth in claim 12, wherein:

said first portion of said multi-piece body is configured to shear before said second portion of said multi-piece body, wherein shearing of said first portion and said second portion of said multi-piece body allows the setting tool to be removed while said bridge plug remains in the operating position.

14. The bridge plug as set forth in claim 13, wherein:

said second portion of said multi-piece body is an inwardly extending annular portion that engages a removable cap of the setting tool.

15. A bridge plug configured to be installed in a well bore in an operating position by a setting tool for isolating a portion of the well bore, said bridge plug comprising:

a multi-piece body configured to be installed in an operating position in a well bore wherein said multi-piece body is fixed to the well bore when installed in the operating position, said multi-piece body of said bridge plug having an end cap, said end cap of said multi-piece body being positioned adjacent a terminal end of a setting tool and spaced from a sealing element configured to engage an end of said multi-piece body opposite an end of said multi-piece body adjacent the terminal end of the setting tool, said end cap of said multi-piece body having an inwardly projecting annular portion, said inwardly projecting annular portion being configured to shear during setting of said multi-piece body.

16. The bridge plug as set forth in claim 15, wherein:

said inwardly extending annular portion is configured to directly contact a portion of a removable cap of the setting tool.

17. The bridge plug as set forth in claim 16, wherein:

said multi-piece body includes a shear portion adjacent an end of said multi-piece body opposite said end cap of said multi-piece body, said shear portion being configured to shear before said inwardly projecting annular portion is sheared during setting of said bridge plug.

18. The bridge plug as set forth in claim 17, wherein:

said shear portion is configured to directly engage a portion of the setting tool.

19. The bridge plug as set forth in claim 18, wherein:
said bridge plug is configured so that no portion of the setting tool shears during installation of said bridge plug and removal of the setting tool.

20. The bridge plug as set forth in claim 19, wherein:
said multi-piece body being dissolvable at least in part.

* * * * *